US006682167B2

(12) United States Patent
Davis et al.

(10) Patent No.: US 6,682,167 B2
(45) Date of Patent: Jan. 27, 2004

(54) REDUCING PRINTHEAD SERVICING NOISE

(75) Inventors: Robert D. Davis, Brush Prairie, WA (US); Mike Burton, Vancouver, WA (US); Bruce A. Axten, Vancouver, WA (US); Jafar N. Jefferson, Vancouver, WA (US); Daniel J. Magnusson, Vancouver, WA (US)

(73) Assignee: Hewlett-Packard Development, Houston, TX (US)

( * ) Notice: Subject to any disclaimer, the term of this patent is extended or adjusted under 35 U.S.C. 154(b) by 0 days.

(21) Appl. No.: 10/183,846

(22) Filed: Jun. 27, 2002

(65) Prior Publication Data

US 2004/0001118 A1 Jan. 1, 2004

(51) Int. Cl.[7] ..... B41J 2/165
(52) U.S. Cl. ..... 347/32
(58) Field of Search ..... 347/32, 29, 22, 347/20, 1, 84, 85, 86, 87; 73/37, 54.14, 64.51, 64.48, 53.01

(56) References Cited

U.S. PATENT DOCUMENTS 6,315,386 B1 11/2001 Bailey et al.

*Primary Examiner*—Raquel Yvette Gordon

(57) ABSTRACT

A method for reducing a servicing noise is provided. In a measuring action, a servicing position is measured using a full pushing force of an actuator applied to a service station. In a disengaging action, the actuator is disengaged from the service station. In a reducing action, the pushing force is reduced to a minimum value. In an engaging action, the service station is engaged with the actuator. In a monitoring action, a position of the actuator is monitored during the engagement. In a comparing action, the actuator position is compared to the stored servicing position. In an increasing action, the pushing force is increased for future engagements if the servicing position has not been reached. A printing mechanism configured to employ such a method is also provided.

20 Claims, 5 Drawing Sheets

REDUCING PRINTHEAD SERVICING NOISE

Printing mechanisms often include an inkjet printhead which is capable of forming an image on many different types of media. The inkjet printhead ejects droplets of colored ink through a plurality of orifices and onto a given media as the media is advanced through a printzone. As used herein, the term "media" may refer to one or more medium. The printzone is defined by the plane created by the printhead orifices and any scanning or reciprocating movement the printhead may have back-and-forth and perpendicular to the movement of the media. Methods for expelling ink from the printhead orifices, or nozzles, include piezo-electric and thermal techniques. For instance, two earlier thermal ink ejection mechanisms are shown in U.S. Pat. Nos. 5,278,584 and 4,683,481, both assigned to the present assignee, the Hewlett-Packard Company.

A printing mechanism may have one or more inkjet printheads, corresponding to one or more colors, or "process colors" as they are referred to in the art. Many inkjet printing mechanisms contain a service station for maintenance of the inkjet printheads. The service station may include scrapers, ink-solvent applicators, primers, and/or caps to help keep the nozzles from drying out during periods of inactivity.

Some service stations are configured to minimize space and/or reduce cost by moving substantially in-line with the motion of the printheads, and by being activated into a servicing position by a carriage transporting the printheads. One such in-line service station can be found in U.S. Pat. No. 6,315,386. While in-line service stations can save space, the process of activating the service station into the servicing position can create an undesirable amount of noise.

DETAILED DESCRIPTION OF THE PREFERRED EMBODIMENTS

Figure 1:
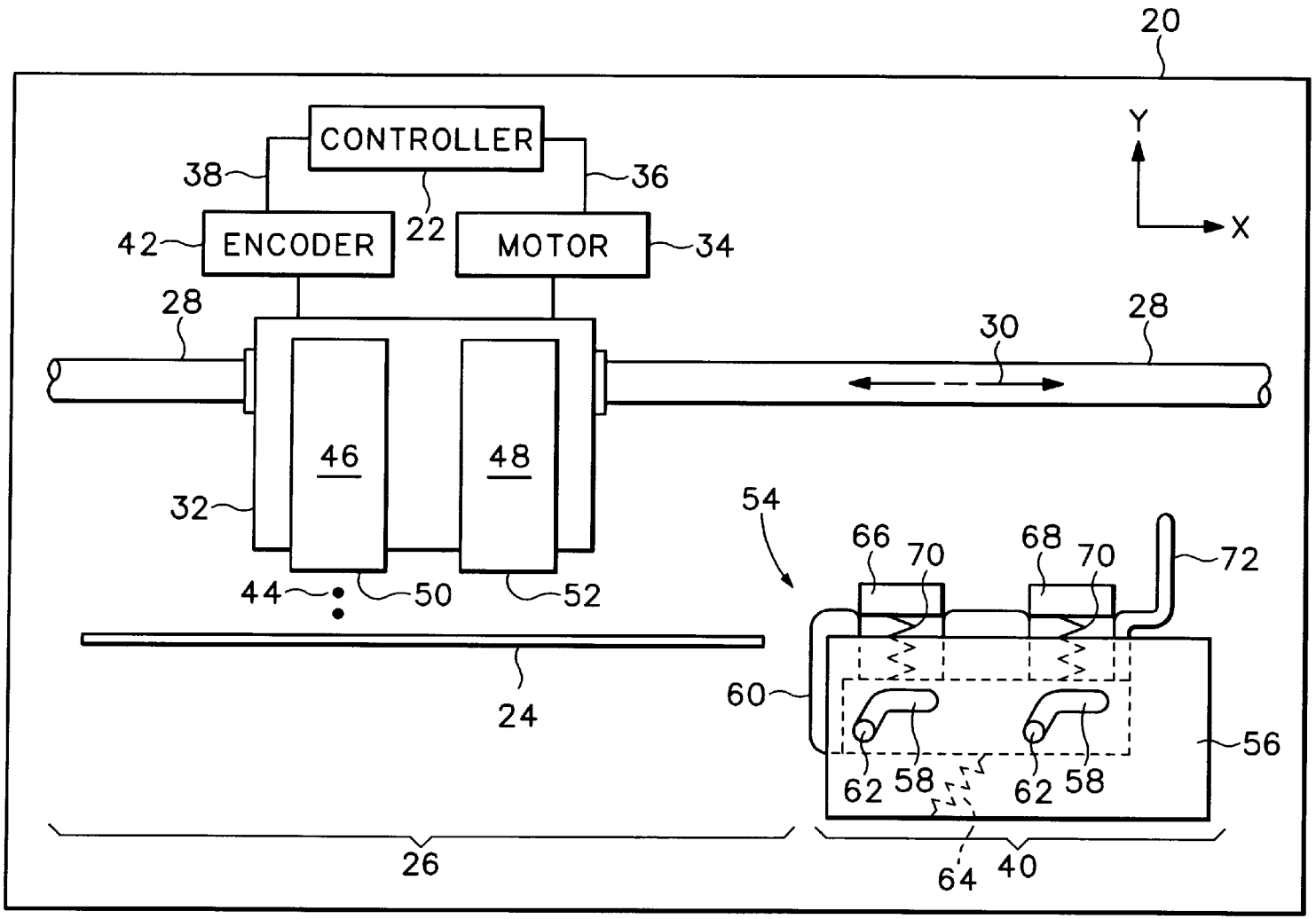
FIGS. 1–3 schematically illustrate one embodiment of a printing mechanism having an in-line service station.

FIG. 1 schematically illustrates one embodiment of a printing mechanism, here shown as an inkjet printer 20, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, video printers, and facsimile machines, to name a few. For convenience the concepts introduced herein are described in the environment of an inkjet printer.

While it is apparent that the printer components may vary from model to model, the typical inkjet printer 20 includes a printer controller 22 that receives instructions from a host device, such as a computer or personal data assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A print media handling system (not shown) may be used to advance a sheet of print media 24 through a printzone 26 for printing. A carriage guide rod 28 is positioned within the inkjet printer 20 to define a scanning axis 30. In the case of FIG. 1, the scanning axis 30 is parallel to the X-axis. The guide rod 28 slidably supports an inkjet carriage 32 for travel back and forth, reciprocally, across the printzone.26. A carriage drive motor 34 is coupled to the carriage 32, and may be used to propel the carriage 32 in response to an input 36 received from the controller 22. To provide carriage position feedback information 38 to controller 22, a conventional encoder strip (not shown) may be extended along the length of the printzone 26 and over a servicing region 40. An optical encoder reader may be mounted on the back surface of printhead carriage 32 to read position information provided by the encoder strip, for example, as described in U.S. Pat. No. 5,276,970, also assigned to the Hewlett-Packard Company, the present assignee. Such an encoder is schematically illustrated as encoder block 42 in FIG. 1. Position feedback 38 may be provided by other techniques familiar to those skilled in the art, for example, by connecting an encoder to the motor 36, rather than to the printhead carriage 32 as illustrated in this embodiment.

In the printzone 26, the media sheet 24 receives ink 44 from an inkjet cartridge, such as a black ink cartridge 46 or a color ink cartridge 48. The illustrated printer 20 uses replaceable printhead cartridges where each cartridge has a reservoir that carries the entire ink supply as the printhead reciprocates across the printzone 26. As used herein, the term "cartridge" may also refer to an "off-axis" ink delivery system, having main stationary reservoirs (not shown) for each ink located in an ink supply region. In an off-axis system, the cartridges may be replenished by ink conveyed through a flexible tubing system from the stationary main reservoirs which are located "off-axis" from the path of printhead travel, so only a small ink supply is propelled by carriage 32 across the printzone 26. Other ink delivery or fluid delivery systems may also employ the systems and methods described herein, such as cartridges which have ink reservoirs that snap onto permanent or semi-permanent printheads.

The illustrated black ink cartridge 46 has a printhead 50, and color ink cartridge 48 has a tri-color printhead 52 which ejects cyan, magenta, and yellow inks. In response to firing command control signals delivered from the controller 22 to the printhead carriage 32, the printheads 50, 52 selectively eject ink 44 to form an image on a sheet of media 24 when in the printzone 26. The printheads 50, 52 are thermal inkjet printheads, although other types of printheads may be used, such as piezoelectric printheads.

Between print jobs, the inkjet carriage 32 moves along the carriage guide rod 28 to the servicing region 40 where a service station 54 may perform various servicing functions known to those in the art, such as, priming, scraping, and capping for storage during periods of non-use to prevent ink from drying and clogging the inkjet printhead nozzles. For simplicity, the service station 54 is illustrated as a capping station.

The service station 54 has a frame 56 which defines a series of guide slots 58. Two guide slots 58 are located on the front of the frame 56 as visible in FIG. 1. Two similar guide slots 58 are located on the back of the frame 56 (not shown). A maintenance sled 60 is supported by the frame 56 on guide posts 62 which protrude from the maintenance sled 60 to slidably engage the guide slots 58. A biasing spring 64 couples the sled 60 to the frame 56, biasing the sled 60 in a negative X-axis direction and a negative Y-axis direction. As illustrated in FIG. 1, the maintenance sled 60 is in a retracted position. The maintenance sled 60 has a black printhead cap 66 and a color printhead cap 68 which are moveably coupled to the sled 60, and biased in a positive Y-axis direction by capping springs 70. The maintenance sled 60 also has an activation arm 72 protruding upwards from the sled 60. The frame 56 is supported and held in a fixed position by a chassis (not shown) of the inkjet printer 20.

Figure 2:
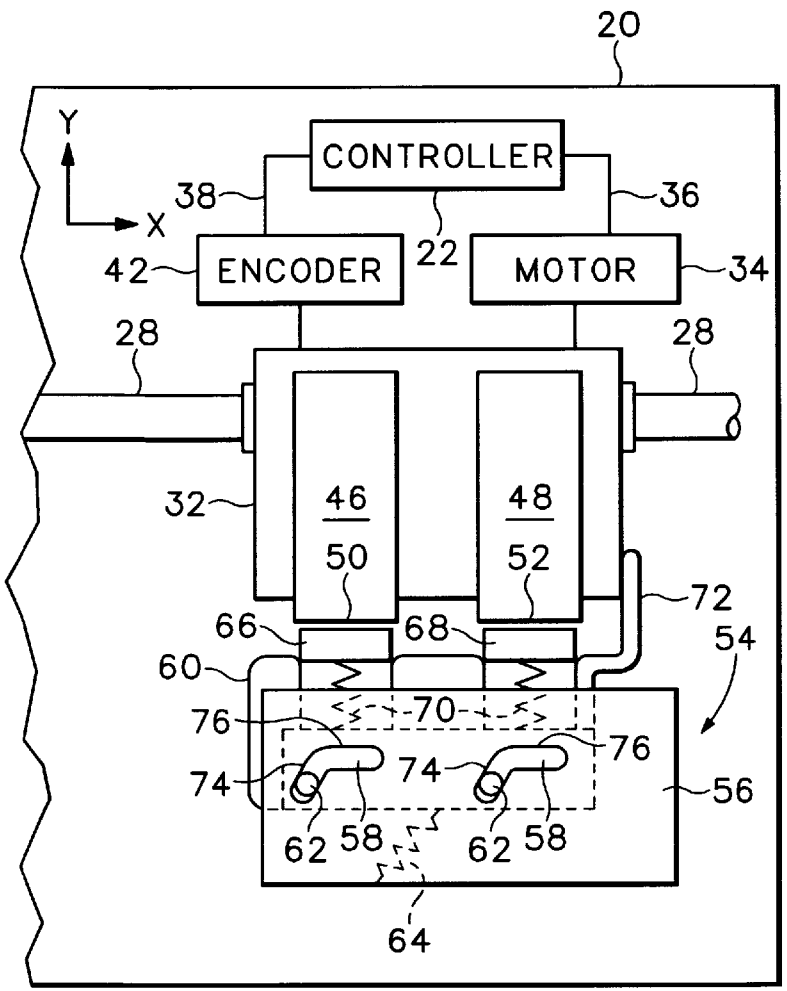

As FIG. 2 illustrates, the printhead carriage 32 maybe moved along the carriage guide rod 28 in the positive X-axis direction until the carriage 32 contacts the activation arm 72. After contacting the activation arm 72, as the carriage 32 continues to move in the positive X-axis direction, the guide posts 62 move within the guide slots 58, first up a ramp portion 74 and towards a top of the ramp portion 76. The activation arm 72 is constructed to contact the carriage 32 when the printhead caps 66, 68 are horizontally aligned (along the X-axis) with their corresponding printheads 50, 52. While there is horizontal alignment between the printhead caps 66, 68 and the printheads 50, 52 when the carriage 32 initially contacts the activation arm 72, the caps 66, 68 do not contact the printheads 50, 52 until the carriage 32 continues to move the maintenance sled 60 further upwards as defined by the motion allowed by the guide slots 58 and the guide posts 62. When the guide posts 62 move up the ramp 74 and approach the top of the ramp 76, the caps 66, 68 will engage their respective printheads 50, 52. As the carriage 32 continues to move along the carriage guide rod 28 in the positive X-axis direction, the maintenance sled 60 moves upwards relative to the printheads 50, 52, causing the capping springs 70 to compress. Since the printheads 50, 52 are held in place by the printhead carriage 32, the force in the positive Y-axis direction provided by the capping springs 70 tends to lift the carriage against the guide rod 28, and may even cause a slight deflection of the guide rod 28.

Figure 3:
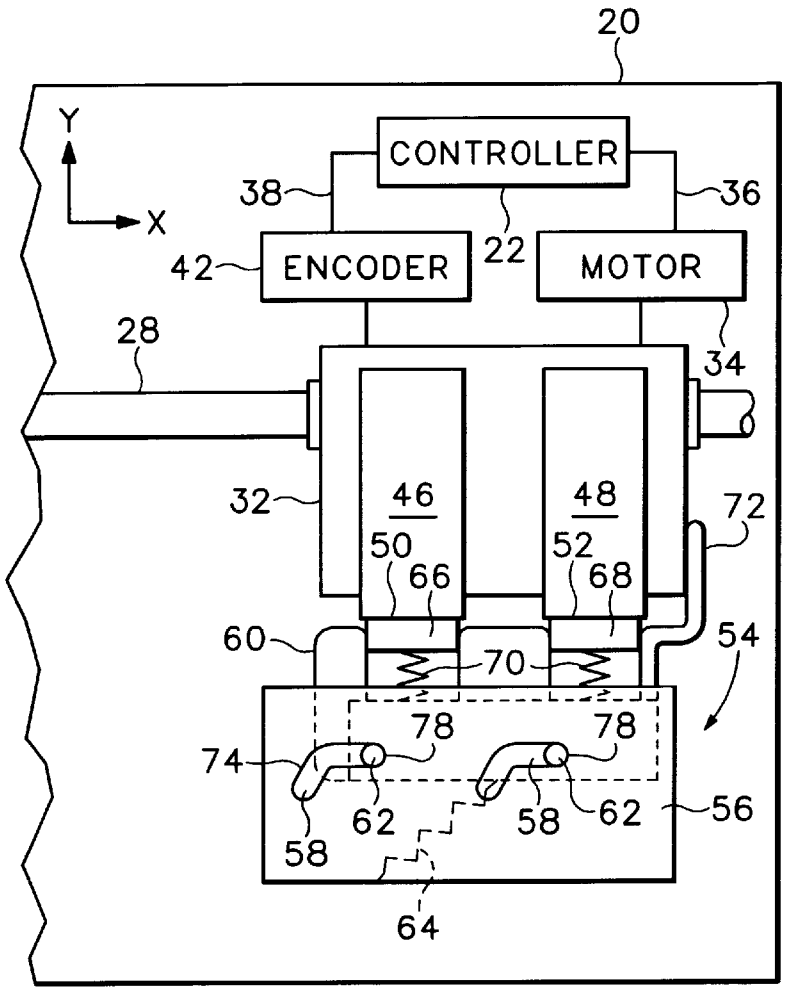

As the printhead carriage 32 continues to move in the positive X-axis direction, the guide posts 62 reach the top of the ramp 76. At this point, the capping force exerted by the capping springs 70 remains relatively constant, since the capping springs 70 will not compress further. As FIG. 3 illustrates, the printhead carriage 32 can continue moving in the positive X-axis direction until the guide posts 62 reach the top end 78 of the guide slots 58. When the guide posts 62 have reached the top end 78 of the guide slots 58, the maintenance sled 60 is considered to be in a servicing position. In other embodiments, the maintenance sled 60 can reach the servicing position when the guide posts 62 have not reached the top end 78 of the guide slots, for example, in a situation where there is an alternate physical stop which the carriage 32 or the ink cartridges 46, 48 contact to prevent further motion and therefore determine the servicing position.

When the printhead carriage 32 is moved back in the negative X-axis direction, the biasing spring 64 maintains contact between the activation arm 72 and the carriage 32. As the carriage 32 moves in the negative X-axis direction, the guide posts 62 move within the guide slots 58, back past the top of the ramp 76 and down the ramp portion 74 until the maintenance sled 60 is in the retracted position once again. When the maintenance sled 60 reaches the retracted position, the carriage 32 will disengage the activation arm 72 as the carriage is moved further in the negative X-axis direction.

Given the torque capabilities of the motor 34 which is moving the printhead carriage 32, and the mass of the ink cartridges 46, 48, as well as the carriage 32 itself, it is often not possible for the carriage 32 to slowly engage the activation arm 72 and move the maintenance sled 60 from the retracted position to the servicing position in a slow and steady manner. Instead, it is often necessary to move the printhead carriage 32 a distance away from the service station 54 in the negative X-axis direction, and provide an input 36 to the motor 34 which will accelerate the printhead carriage 32 to a desired velocity before contacting the activation arm 72. The momentum achieved by doing this is sufficient to overcome the forces associated with the guide posts 62 climbing the ramp 74, compressing the capping springs 70, and lifting the carriage guide rod 28. Since these forces may vary over time depending on the age of the system and the manufacturing tolerances involved, it may be desirable to use a "full force push" by the printhead carriage 32 to guarantee that the maintenance sled 60 reaches the servicing position under all conditions, regardless of the amount of ink in the ink cartridges, the number of ink cartridges present, positioning differences due to manufacturing tolerances, varying friction in the system from one inkjet printer 20 to another, or varying friction in the system over time due to use, aging, contamination, or part wear. The momentum achieved by a full force push is empirically determined to be adequate to move the maintenance sled 60 into the servicing position, regardless of the variable conditions which may exist. A "full force" push or a "full pushing force" is not necessarily as hard as the printhead carriage 32 can push. Rather, a full force push, as used herein and in the claims, is a push determined to be adequate to allow the maintenance sled 60 to reach the servicing position under a number of variable conditions. While this is a robust solution, there will be situations where the full force push will effectively slam the carriage 32 into the activation arm 72, slam the caps 66, 68 into the printheads 50, 52, and/or slam the guide posts 62 into the top end 78 of the guide slots 58, creating undesirable noise from the inkjet printer 20, or possibly unseating one or more of the ink cartridges 46, 48 from the carriage 32.

Figure 4:
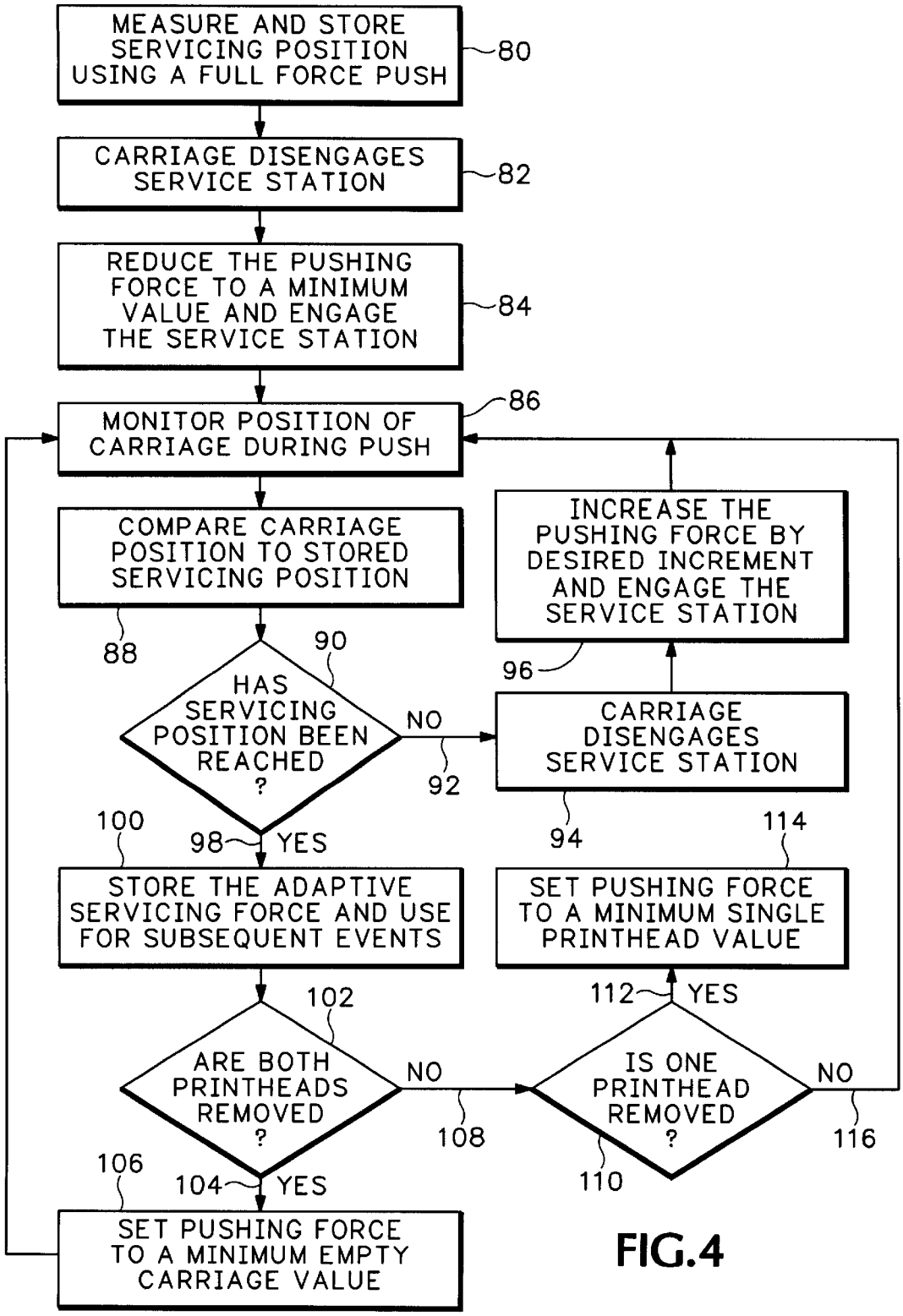
FIG. 4 illustrates one embodiment of actions which adapt a servicing force for a service station.

FIG. 4 illustrates one embodiment of actions which adapt a servicing force for a service station. Based on feedback from the encoder 42, the controller 22 is able to know the position of the printhead carriage 32 as it moves along the carriage guide rod 28 in the positive and negative X-axis directions. Using a full force push as described above, the controller can measure and store 80 the servicing position in terms of carriage position. After measuring and storing 80 the servicing position in terms of carriage position by using a full force push, the carriage disengages 82 the service station, and the controller reduces 84 the pushing force to a minimum value and engages the service station. Recall that the force of the push is determined in part by the velocity of the printhead carriage 32 when it contacts the activation arm 72. The velocity of the printhead carriage 32 is a function of the input 36 to the motor 34, the resistance to movement provided by the mass of the carriage 32 and the ink cartridges 46, 48, and the distance the carriage 32 has to travel before contacting the activation arm 72. The motor input 36 will determine the power given to the motor 34, and therefore will affect the acceleration of the printhead carriage 32. If the carriage 32 is allowed to accelerate over a larger distance, it will reach a higher velocity, and will be capable of pushing the activation arm 72 with a greater force. Therefore, to reduce the pushing force to a minimum value, the controller can reduce the level of motor input 36 and/or start the carriage 32 closer to the activation arm so that the carriage 32 will not accelerate to as high of a velocity as it can with the full force push. The minimum force can be calculated or empirically determined based on best case scenarios. Best case scenarios for a minimum force include a broken-in motor, nearly empty print cartridges, cap springs 70 which have a low force, and well-lubricated parts with minimal friction. As used herein and in the appended claims, the term "minimal force" or "minimum value" does not necessarily refer to an absolute lowest amount or value. Rather, "minimum force" and/or "minimum value" can also refer to a reduced or smaller value as compared to another value. For example, a minimum force can be any force which is less than the full force, and not necessarily the lowest possible force.

During the reduced force push, the controller monitors 86 the position of the printhead carriage. The carriage position is compared 88 to the stored servicing position. The controller then determines 90 if the servicing position has been reached based on the encoder position. If the servicing position has not been reached 92, the carriage is disengaged 94 from the service station, and the pushing force is increased 96 by a desired increment and the service station is engaged by the carriage. The controller again monitors 86 the position of the carriage, and compares 88 the position of the carriage to the stored servicing position. If the servicing position has been reached 98, the force used during the push is stored 100 as an adaptive servicing force for use with subsequent servicing events.

The controller may monitor 102 to see if both printheads have been removed. If both printheads have been removed 104, the pushing force is set 106 to a minimum empty carriage value. The carriage can then be monitored 86 during subsequent pushes, and the push force increased 96 if necessary as described above. If the controller determines that both printheads have not been removed 108, the controller may also determine 110 whether one of the printheads has been removed. If one of the printheads has been removed 112, the pushing force is set 114 to a minimum single printhead value. The carriage can then be monitored 86 during subsequent pushes, and the push force increased 96 if necessary as described above. If none of the printheads have been removed 116, the controller may continue to monitor 86 the carriage position during subsequent pushes. Although the embodiment of FIG. 4 uses the example of a carriage 32 which is capable of holding a maximum of two printheads, a similar process could be used for a carriage with any number of printheads. Instead of setting 106 the pushing force to a minimum empty carriage value, or setting 114 the pushing force to a minimum single printhead value, the controller would reduce the pushing force to an alternate minimum value which corresponded to the number of printheads remaining in the carriage. It should be understood that in other embodiments, it may be preferable to determine if any printheads have been removed from the carriage prior to reducing 84 the pushing force to a minimum value and engaging the service station for the first time.

This adaptive servicing method allows the minimum force required to service the printheads 50, 52, in this case the minimum force required to cap the printheads, to be used. This produces less noise and less part wear than a non-adaptive full-force approach. This minimum force can be referred to as the adaptive servicing force. The adaptive servicing force may be represented by a starting distance from the service station 54 and the level of the motor input 36 provided during the push. The motor input 36 is commonly provided using pulse-width-modulation (PWM).

Figure 5:
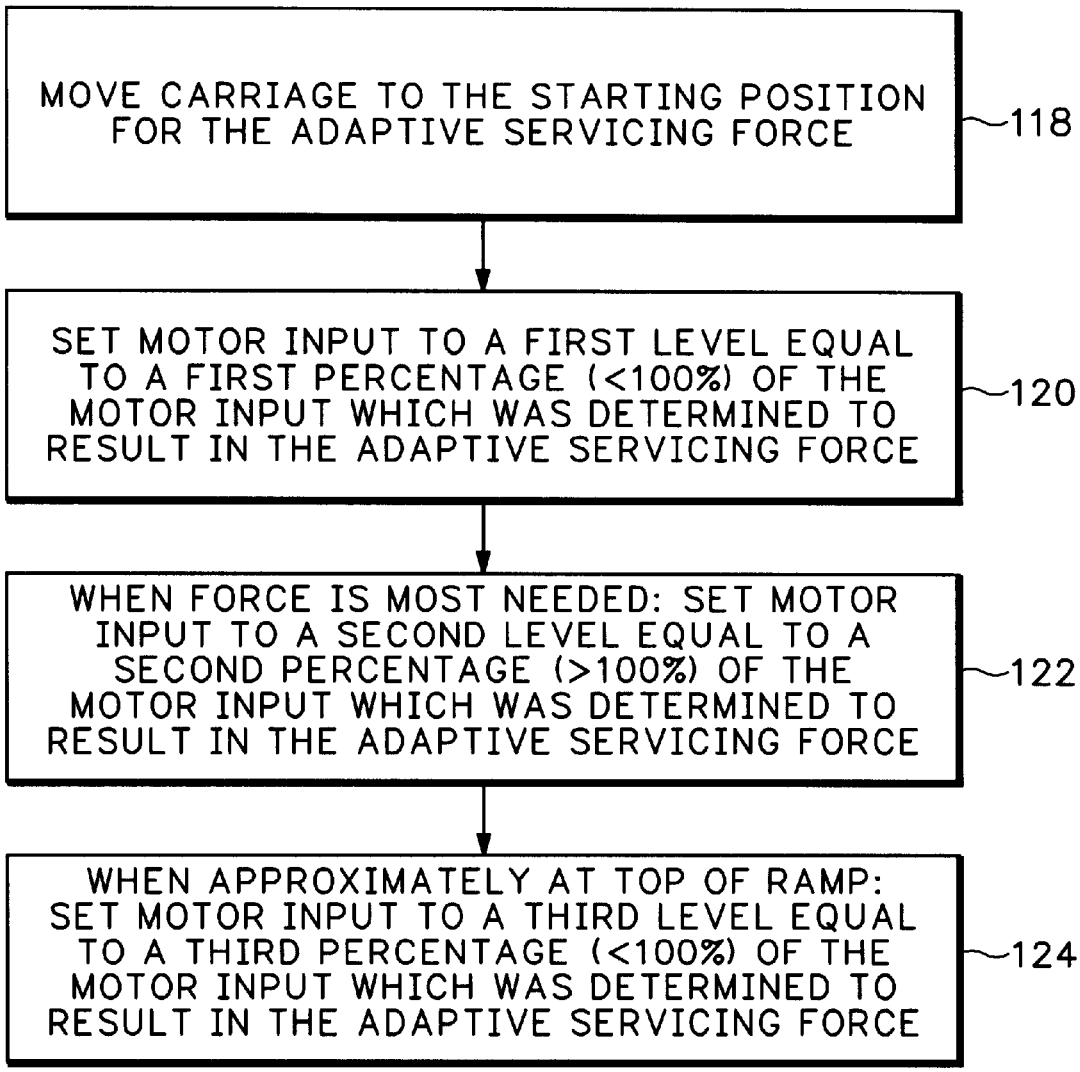
FIG. 5 illustrates another embodiment of actions which adapt a servicing force for a service station.

FIG. 5 illustrates another embodiment of actions which adapt a servicing force for a service station. The actions in FIG. 5 make use of the adaptive servicing force determined in the previously discussed process of FIG. 4. The servicing position was determined during the full force push. Based on a knowledge of the dimensions of the service station 54, and the knowledge of the servicing position, an estimate can be made of the location where the caps 66, 68 will contact the pens and therefore, where the cap springs 70 start to compress, and the carriage guide rod 28 begins to deflect. An estimate can also be made of the position of the top of the ramp 76.

Prior to moving the printhead carriage to the servicing position, the carriage is moved 118 to the starting position for the adaptive servicing force determined during the previous actions. The motor input is set 120 to a first level equal to a first percentage of the motor input which was determined to result in the adaptive servicing force. This first percentage is less than one-hundred percent, and this first motor input level is chosen to be sufficient to move the carriage, engage the activation arm 72, and start the guide posts 62 moving up the ramp 74. The motor input is then set 122 to a second level equal to a second percentage of the motor input which was determined to result in the adaptive servicing force. This second percentage is greater than one-hundred percent, and is chosen to be sufficient to overcome the opposing cap spring 70 compression force as well as the opposing force from the carriage guide rod 28 as it is deflected. When the guide posts 62 have reached the top of the ramp 76, the motor input is set 124 to a third level equal to a third percentage of the motor input which was determined to result in the adaptive capping force. This third percentage is less than one-hundred percent, and is chosen to allow the maintenance sled 60 to reach the servicing position. The first and third percentages may be different or the same.

The actions of FIGS. 4 and 5 provide several advantages. The actions of FIG. 4 enable the determination of a minimum amount of force, referred to herein as the adaptive servicing force, required to move to the servicing position for a given printer under a given set of circumstances. By determining and using the adaptive servicing force, the amount of noise made while moving the printhead carriage to the servicing position is reduced as compared to servicing with a full force push. The actions of FIG. 5 may be used in combination with those of FIG. 4. By taking a carriage starting position and a fixed motor input required to produce the adaptive servicing force, keeping the starting position, and varying the motor input based on percentages of the fixed input level, the amount of noise made during the movement to the servicing position can be further reduced. In addition to noise reductions, the actions of FIGS. 4 and 5 can also reduce part wear. Furthermore, the noise and part wear reductions are adaptable to each printing mechanism and for a given printing mechanism over time, as parts age and/or get contaminated and as the number of ink cartridges or amount of ink in the cartridges may vary.

Figure 6:
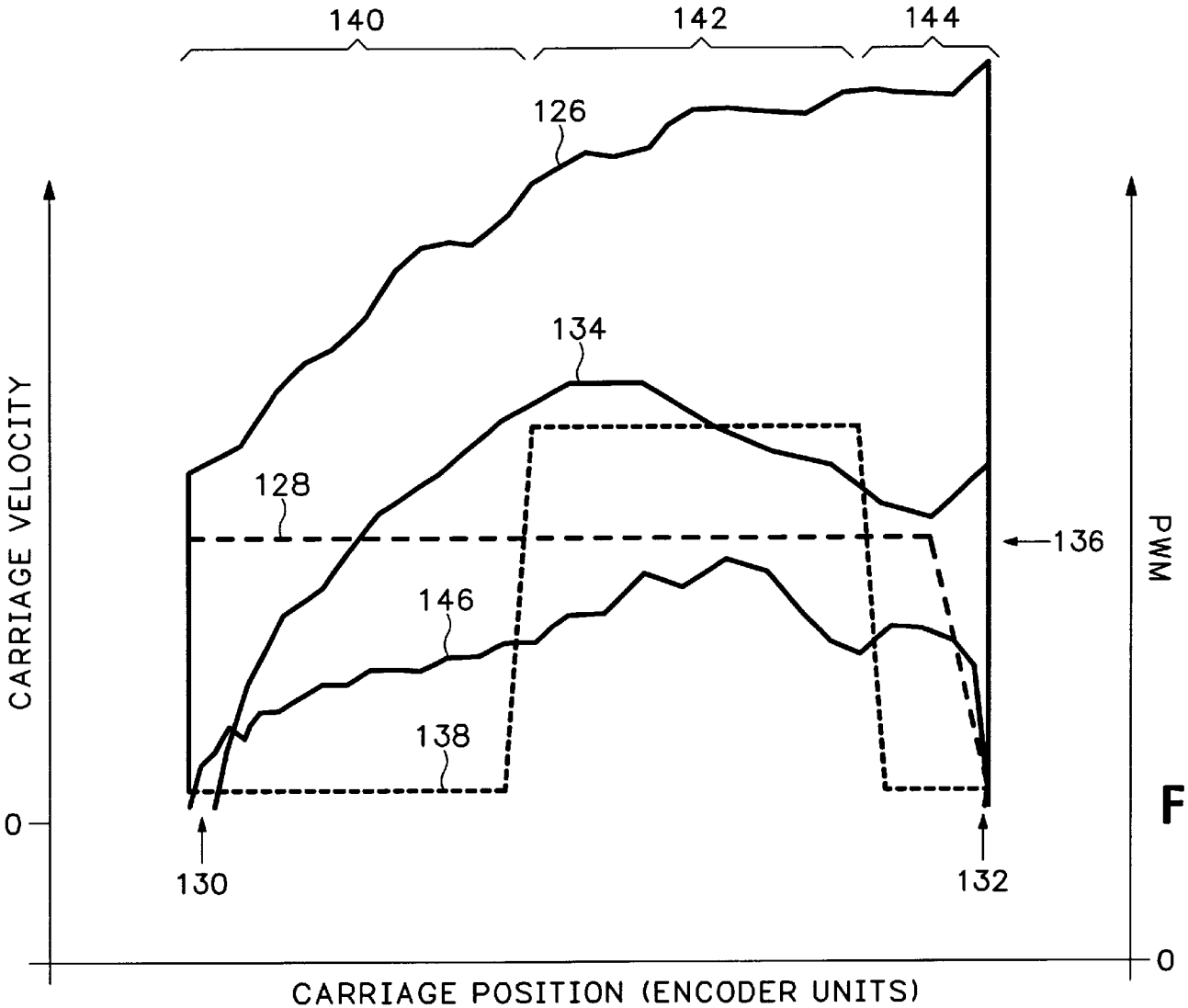
FIG. 6 illustrates one embodiment of velocity and pulse width modulation curves for a printhead carriage.

FIG. 6 illustrates how the embodied actions of FIGS. 4 and 5 might look in terms of a motor input, carriage position, and resultant velocity curves. Full-force velocity curve 126 is illustrated for comparison purposes. The greater the velocity involved during the movement to the servicing position, the greater the noise will be. After completing the actions shown in FIG. 4, the controller will arrive at a fixed motor input as part of its adaptive servicing force. Here, the motor input is expressed in terms of PWM. Fixed motor input curve 128, starting at a carriage position 130, allows the carriage to reach a servicing position 132 with a substantially minimum force. The velocity curve associated with fixed motor input curve 128 is adaptive velocity curve 134. Adaptive velocity curve 134 shows that the velocity while moving to the servicing position 132 is significantly less than the velocity during the full force velocity curve 126.

Following the actions of FIG. 5, a fixed level 136 of the fixed motor input curve 128 is used to determine an optimized motor input curve 138. During a first period 140, a scaling percentage less than one-hundred percent is applied to the fixed level 136 to come up with the first period 140 of the optimized motor input curve 138. During a second period 142, a scaling percentage greater than one-hundred percent is applied to the fixed level 136 to come up with the second period 142 of the optimized motor input curve 138. During a third period 144, a scaling percentage less than one-hundred percent is applied to the fixed level 136 to come up with the third period 144 of the optimized motor input curve 138. Optimized velocity curve 146 corresponds to the optimized motor input curve 138, and is significantly lower than adaptive velocity curve 134, thereby significantly reducing noise levels.

Performing adaptive printhead servicing actions and optimized servicing actions enables a printing mechanism to reliably cap or service printheads with a significantly reduced level of noise. Although capping has been used as an example of one possible servicing technique, the adaptive and optimizing actions described herein can also be applied to other types of printhead servicing, such as scrapping and wiping. The service station 54, illustrated in the above embodiments, is not meant to be limiting in terms of the type of service station the adaptive printhead servicing actions and optimized servicing actions may be used with. Also, the actuator for the service station which contacts the activation arm 72 need not be a printhead carriage 32. The printhead carriage 32 should be thought of more broadly as an actuator which is coupled to a motor and which comes into contact with the activation arm 72. In the case where some other actuator is contacting the activation arm, the actuator would not need to move parallel or in-line with the scanning axis 30 of the printhead carriage. Regardless of the actuator used, the benefit of being able to reliably service the printheads while minimizing noise levels could still be realized and should fall within the scope of this disclosure. In discussing various components of the adaptive printhead servicing actions and optimized servicing actions, various benefits have been noted above.

It is apparent that a variety of other functionally and/or structurally equivalent modifications and substitutions may be made to perform adaptive printhead servicing actions and optimized servicing actions according to the concepts covered herein depending upon the particular implementation, while still falling within the scope of the claims below.

We claim:

1. A method for reducing a servicing noise, comprising:

measuring a servicing position using a full pushing force of an actuator applied to a service station;

disengaging the actuator from the service station;

reducing the pushing force to a minimum value;

engaging the service station with the actuator;

monitoring a position of the actuator during the engagement;

comparing the actuator position to the stored servicing position; and increasing the pushing force for future engagements if the servicing position has not been reached.

2. The method of claim 1, further comprising:

repeating the disengaging, engaging, monitoring, comparing, and increasing actions until the servicing position has been reached; and storing the pushing force needed to reach the servicing position as an adaptive servicing force.

3. The method of claim 2, wherein the actuator is a printhead carriage configured to transport at least one printhead.

4. The method of claim 3, further comprising:

determining if any printheads have been removed from the printhead carriage;

reducing the pushing force to an alternate minimum value which corresponds to a number of printheads remaining in the printhead carriage;

repeating the disengaging, engaging, monitoring, comparing, and increasing actions until the servicing position has been reached; and storing the pushing force needed to reach the servicing position as the adaptive servicing force.

5. The method of claim 2, wherein the adaptive servicing force is stored in terms of a starting position of the actuator and fixed level of input for the actuator.

6. The method of claim 5, further comprising:

moving the actuator to the starting position for the adaptive servicing force;

moving the actuator towards the servicing position with a first input level equal to a first percentage of the fixed input level, wherein the first percentage is less than one-hundred percent;

at a first position, after the starting position, changing the first input level to a second input level equal to a second percentage of the fixed input level, wherein the second percentage is greater than one-hundred percent; and at a second position, after the first position, changing the second input level to a third input level equal to a third percentage of the fixed input level, wherein the third percentage is less than one-hundred percent.

7. The method of claim 6, wherein:

the actuator is a printhead carriage configured to transport at least one printhead;

the service station comprises:

a frame which defines guide slots therein, the guide slots having a ramp portion and a top of the ramp;

a maintenance sled having an activation arm, guide posts which slidably engage the guide slots, and maintenance elements for servicing at least one printhead;

the first position occurs after the printhead carriage has made contact with the activation arm, and the guide posts are on the ramp portion of the guide slots; and the second position occurs prior to the guide posts reaching the top of the ramp in the guide slots.

8. The method of claim 6, wherein the first input level, the fixed input level, the second input level, and the third input level are determined in terms of pulse-width modulation.

9. A printing mechanism, comprising:

a printhead carriage;

a service station;

a controller coupled to the carriage and configured to:

measure a servicing position using a full pushing force of the carriage applied to the service station;

disengage the carriage from the service station;

reduce the pushing force to a minimum value;

engage the service station with the carriage;

monitor a position of the carriage during the engagement;

compare the carriage position to the stored servicing position; and increase the pushing force if the servicing position has not been reached.

10. The printing mechanism of claim 9, wherein the controller is further configured to:

repeat the disengaging, engaging, monitoring, comparing, and increasing actions until the servicing position has been reached; and store the pushing force needed to reach the servicing position as an adaptive servicing force.

11. The printing mechanism of claim 10:

further comprising a motor coupled between the controller and the carriage; and wherein the service station comprises:

a frame which defines guide slots therein, the guide slots having a ramp portion and a top of the ramp; and a maintenance sled having an activation arm, guide posts which slidably engage the guide slots, and at least one maintenance element for servicing at least one printhead.

12. The printing mechanism of claim 11, wherein the adaptive servicing force is stored in terms of a starting position of the carriage and a fixed motor input level.

13. The printing mechanism of claim 12, wherein the controller is configured to adjust the adaptive servicing force for noise reduction by:

moving the carriage to the starting position for the adaptive servicing force;

moving the carriage towards the servicing position with a first motor input level equal to a first percentage of the fixed motor input level, wherein the first percentage is less than one-hundred percent;

at a first position, after the starting position, changing the first motor input level to a second motor input level equal to a second percentage of the fixed motor input level, wherein the second percentage is greater than one-hundred percent; and at a second position, after the first position, changing the second motor input level to a third motor input level equal to a third percentage of the fixed motor input level, wherein the third percentage is less than one-hundred percent.

14. The printing mechanism of claim 13, wherein:

the first position occurs after the carriage engages the service station and before the guide posts of the maintenance sled have reached the top of the guide slot ramps; and the second position occurs when the guide posts have substantially reached the top of the ramp.

15. The printing mechanism of claim 13, wherein the first percentage and the second percentage are equal.

16. The printing mechanism of claim 13, wherein the first motor input level, the fixed motor input level, the second motor input level, and the third motor input level are determined by pulse-width modulation.

17. The printing mechanism of claim 11, wherein at least one maintenance element comprises a printhead cap.

18. The printing mechanism of claim 11, wherein at least one maintenance element comprises a printhead wiper.

19. A printing mechanism, comprising:

a service station;

an actuator for actuating the service station;

a controller coupled to the actuator and configured to:

measure a servicing position using a full pushing force of the actuator applied to the service station;

disengage the actuator from the service station;

reduce the pushing force to a minimum value;

engage the service station with the actuator;

monitor a position of the actuator during the engagement;

compare the actuator position to the stored servicing position; and increase the pushing force if the servicing position has not been reached.

20. The printing mechanism of claim 19, wherein the controller is further configured to:

repeat the disengaging, engaging, monitoring, comparing, and increasing actions until the servicing position has been reached; and store the pushing force needed to reach the servicing position as an adaptive servicing force.

* * * * *